US011774156B2

(12) United States Patent
Little et al.

(10) Patent No.: US 11,774,156 B2
(45) Date of Patent: Oct. 3, 2023

(54) METHODS OF PRODUCING CLEAR ICE SHAPES USING SUCTION, AND APPARATUSES FOR PERFORMING SAME

(71) Applicant: Wintersmiths, LLC, Waterbury, VT (US)

(72) Inventors: Christopher T. Little, Moretown, VT (US); Patrick W. Little, Redondo Beach, CA (US)

(73) Assignee: Wintersmiths, LLC, Waterbury, VT (US)

( * ) Notice: Subject to any disclaimer, the term of this patent is extended or adjusted under 35 U.S.C. 154(b) by 218 days.

(21) Appl. No.: 16/879,608

(22) Filed: May 20, 2020

(65) Prior Publication Data

US 2020/0370810 A1 Nov. 26, 2020

Related U.S. Application Data

(60) Provisional application No. 62/850,144, filed on May 20, 2019.

(51) Int. Cl.

| | |
|---|---|
| ***F25C 1/20*** | (2006.01) |
| ***F25C 1/25*** | (2018.01) |
| ***F25C 1/04*** | (2018.01) |

(52) U.S. Cl.

CPC ..... *F25C 1/20* (2013.01); *F25C 1/04* (2013.01); *F25C 1/25* (2018.01); *F25C 2301/00* (2013.01)

(58) Field of Classification Search

CPC ..... F25C 1/04; F25C 1/25; F25C 2301/00; F25C 2400/14; F25C 2323/122

See application file for complete search history.

(56) References Cited

U.S. PATENT DOCUMENTS

| | | | |
|---|---|---|---|
| 3,318,105 | A | 5/1967 | Burroughs et al. |
| 4,852,359 | A | 8/1989 | Mazzotti |
| 5,297,394 | A | 3/1994 | Frohbieter et al. |
| 5,618,463 | A | 4/1997 | Rindler et al. |
| 5,884,490 | A | 3/1999 | Whidden |
| 5,970,735 | A | 10/1999 | Hobelsberger |
| 6,289,683 | B1 | 9/2001 | Daukas et al. |
| 6,345,802 | B2 | 2/2002 | Moore |

(Continued)

FOREIGN PATENT DOCUMENTS

WO WO2017/036557 * 3/2017 ..... F25C 1/24

*Primary Examiner* — Cassey D Bauer

(74) *Attorney, Agent, or Firm* — Downs Rachlin Martin PLLC

(57) ABSTRACT

An icemaker for making clear ice shapes using a process that removes and replenishes a freezable liquid, such as water, from and to one or more ice-mold cavities during freezing of the freezable liquid in the ice-mold cavity(ies). This process removes air bubbles from the freezable liquid during freezing that would otherwise result in cloudy ice. In some embodiments, the icemaker includes a suction system to draw freezable liquid from the cavity(ies) and a replenishment system to replenish the cavity(ies) with freezable liquid to replace the freezable liquid that the suction system draws out of the cavity(ies). In some embodiments, the replenishment includes a reservoir containing freezable liquid and the suction system includes a pump that draws the freezable liquid from the cavity(ies) and discharges it to the reservoir. Methods of making clear ice and other systems for making clear ice are also disclosed.

20 Claims, 13 Drawing Sheets

(56) References Cited

U.S. PATENT DOCUMENTS

| | | | | |
|---|---|---|---|---|
| 6,357,720 | B1 | 3/2002 | Shapiro et al. | |
| 6,857,277 | B2 | 2/2005 | Somura | |
| 6,935,124 | B2 | 8/2005 | Takahashi et al. | |
| 9,074,802 | B2 * | 7/2015 | Culley | F25C 1/25 |
| 9,273,891 | B2 | 3/2016 | Boarman | |
| 9,759,472 | B2 | 9/2017 | Boarman et al. | |
| 9,784,492 | B2 | 10/2017 | Tittle et al. | |
| 10,151,519 | B2 | 12/2018 | Little et al. | |
| 10,443,915 | B2 | 10/2019 | Little et al. | |
| 2004/0025527 | A1 | 2/2004 | Takahashi et al. | |
| 2009/0152438 | A1 | 6/2009 | Chu | |
| 2013/0205820 | A1 * | 8/2013 | Wong | F25C 5/20 62/246 |
| 2015/0027142 | A1 | 1/2015 | Little et al. | |
| 2018/0017308 | A1 * | 1/2018 | Yang | F25D 23/12 |
| 2018/0087817 | A1 * | 3/2018 | Little | F25C 1/18 |

* cited by examiner

METHODS OF PRODUCING CLEAR ICE SHAPES USING SUCTION, AND APPARATUSES FOR PERFORMING SAME

RELATED APPLICATION DATA

This application claims the benefit of priority of U.S. Provisional Patent Application Ser. No. 62/850,144, filed on May 20, 2019, and titled "METHODS OF PRODUCING CLEAR ICE SHAPES USING SUCTION, AND APPARATUSES FOR PERFORMING SAME", which is incorporated by reference herein in its entirety.

FIELD OF THE DISCLOSURE

The present disclosure generally relates to the field of clear icemakers. In particular, the present disclosure is directed to methods of producing clear ice shapes using suction, and apparatuses for performing same.

BACKGROUND

Shaped clear water ice, i.e., water ice that is optically clear and without cloudiness caused by air bubbles trapped within the ice, is popular for many uses, including for chilling drinks containing top-shelf liquor, such as bourbon, scotch, rye, vodka, and tequila, among others. Using clear ice provides the drinks with a pleasing visual aesthetic that enhances the overall experience of the drinkers of such liquors.

A number of devices have been developed in recent years for making clear water ice, particularly clear water ice in relatively large shapes, such as 2.5-inch (64 mm) diameter spheres, 2-inch (50.8 mm)×2-inch (50.8 mm) 2-inch (50.8 mm) cubes, and 1.25-inch (31.75 mm)×1.25-inch (31.75 mm)×5-inch (127 mm) rectangular spears, among others. These larger sizes are particularly desirable to minimize the surface area of ice that the drink is exposed to in order to minimize melting and the resulting dilution of the drink being chilled. One such device is the Ice Chest clear icemaker available from Wintersmiths, LLC, Waterbury, Vt.

The Ice Chest clear icemaker is specially designed to force water with a mold to freeze directionally toward an outlet that is in fluid communication with a thermally insulated space outside the mold. As the water progressively freezes toward the outlet, the impurities, including air bubbles that would cause the ice within the mold to be cloudy, are forced into the thermally insulated space outside the mold, leaving the ice within the mold impurity free and therefore clear. See, for example, U.S. Pat. No. 10,443,915 issued to the present inventors on Oct. 15, 2019, and titled "DEVICES FOR MAKING SHAPED CLEAR ICE", for a more detailed description of how the Ice Chest clear icemaker and similar clear icemakers work. Such directional-freezing-type clear icemakers require a significant amount of thermal insulation to control freezing, and this thermal insulation can increase the time needed to form the finished ice shape.

SUMMARY OF THE DISCLOSURE

In one implementation, the present disclosure is directed to an icemaker for making a body of ice having a shape and a size. The icemaker includes a mold having a closed mold cavity designed and configured to provide the shape and size of the body of ice when the mold is filled with a freezable liquid and the freezable liquid is frozen to form the body of ice; a suction device in fluid communication with the closed mold cavity and designed and configured to, during operation of the icemaker, draw a first portion of the freezable liquid out of the closed mold cavity during freezing of the freezable liquid; and a replenishment system in fluid communication with the closed mold cavity and designed and configured to, during operation of the icemaker, replenish the first portion of the freezable liquid into the closed mold cavity as the suction device draws the first portion from the closed mold cavity.

In another implementation, the present disclosure is directed to a method of making a body of ice having a size and a shape. The method includes filling a closed mold cavity with a freezable liquid, wherein the closed mold cavity has the size and shape of the body of ice; causing the freezable liquid in the closed mold cavity to freeze in an inwardly direction relative to the closed mold cavity; and while causing the freezable liquid to freeze within the closed mold cavity, simultaneously drawing a first portion of the freezable liquid out of the closed mold cavity and replenishing the first portion of the freezable liquid.

BRIEF DESCRIPTION OF THE DRAWINGS

For the purpose of illustration, the drawings show aspects of example embodiments. However, it should be understood that the present disclosure is not limited to the precise arrangements and instrumentalities shown in the drawings, wherein:

FIGS. 8G(1) and 8G(2) are, respectively, enlarged top and bottom isometric views of a removable closure for each of the battery compartment and the pump compartment of the head unit of FIGS. 8A and 8B;

DETAILED DESCRIPTION

Figure 1:
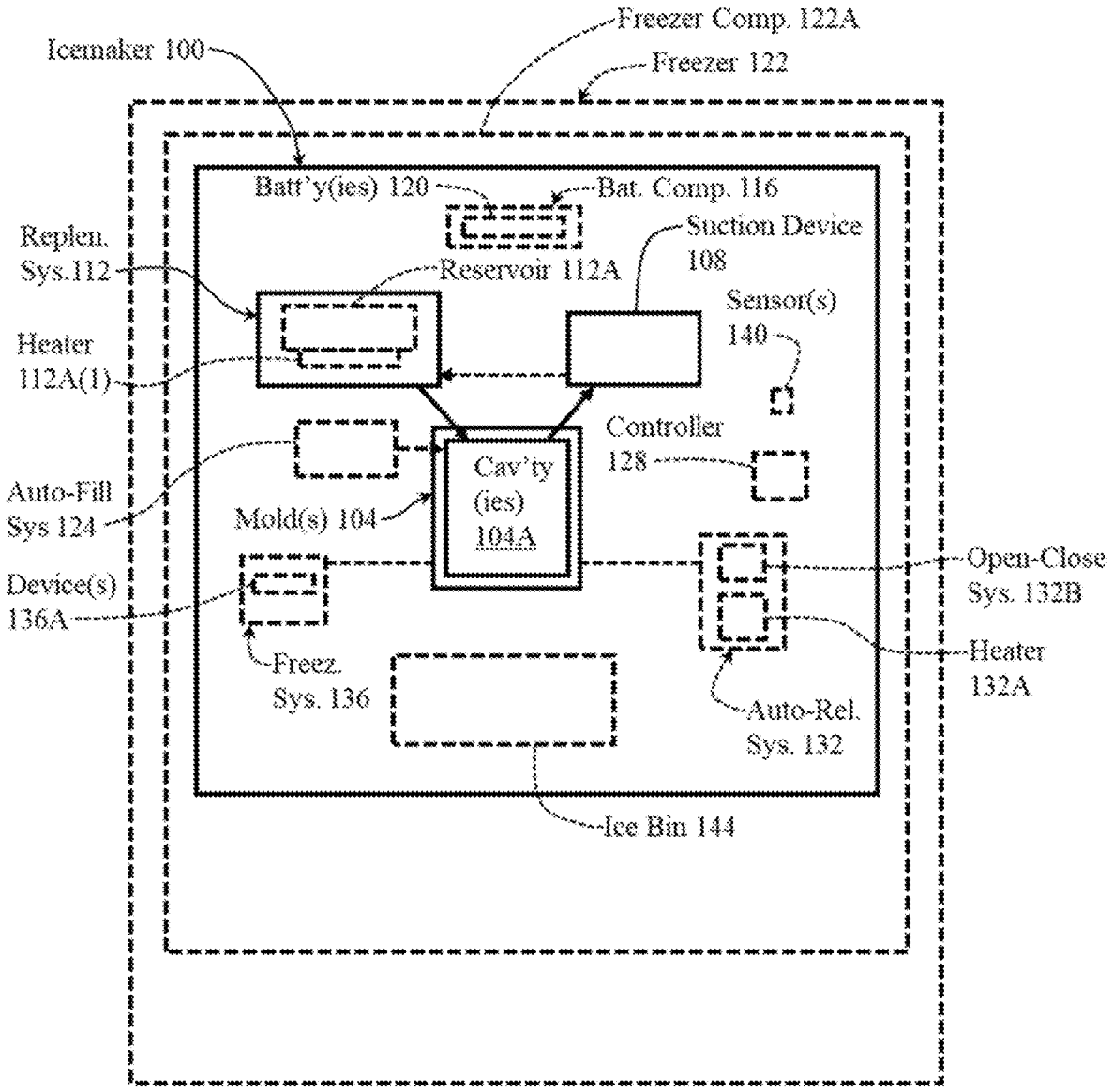
FIG. 1 is a high-level schematic diagram of an icemaker for making one or more clear ice shapes.

In some aspects, the present disclosure is directed to methods of making, from freezable liquids such as water, bodies of ice that are "clear", i.e., that do not contain air bubbles entrapped in the ice that would make the ice cloudy. When the freezable liquid is optically clear and colorless, such as with clean water, the resulting clear ice made in accordance with the present disclosure is also optically clear and colorless. However, in some embodiments neither the freezable liquid, nor the resulting ice, need to be optically clear or colorless. For example, the freezable liquid may be optically transparent but colored so as to provide an optically transparent colored ice. Examples of optically transparent and colored freezable liquids include, but are not limited to, artificially colored water and filtered fruit juices, such as white grape juice, purple grape juice, and cranberry juice, among others. Fundamentally, there is no limitation on the freezable liquid other than it freeze at the requisite temperature. It is also typically desirable, though not necessary, that viewers can visually discern the absence of trapped air bubbles in the ice after freezing.

In some embodiments, the term "clear ice" shall mean that the ice shapes made in accordance with the present disclosure are substantially to completely free of trapped air bubbles frozen into the ice that, if present, would make the ice shapes cloudy in the manner of ice shapes made using conventional uninsulated open-top ice trays and automatic icemakers that use uninsulated open-top molds located in freezer cavities of domestic refrigerator-freezers, as is well known in the art. The term "clear ice" does not exclusively mean optically clear, though in many cases the clear ice shapes made in accordance with the present disclosure will be optically clear. Relative to the term "clear ice", the modifier "substantially" shall mean to a degree that any cloudiness from trapped air bubbles that may be present in an ice shape is not visible with the naked eye from a distance of 12 inches (30.5 cm) after the ice shape has been removed from initially clean room-temperature water after having been immersed in such water for 5 seconds. In the context of clean water ice placed in clean water, "substantially clear" ice may mean that one can see only the outline of the ice shape. In contrast, an ice shape that is not substantially clear will have more of its form visible. Also in the context of ice made from clean water, "substantially clear ice" may include extremely little (e.g., only a spot at the location of an inlet-outlet structure that is the last to freeze) to no cloudiness. In contrast, an ice shape that is not substantially clear will typically have more extensive cloudiness, typically at least at the center of the ice shape.

In some aspects of the present disclosure, clear ice is formed from a freezable liquid by providing, during freezing of the freezable liquid, a suction to one or more ice molds that is constantly pulling a portion of the freezable liquid, and air bubbles and/or other impurities (e.g., any one or more of a variety of minerals present in some water sources) contained therein, out of each mold cavity, as another portion of the freezable liquid remaining in the mold cavity(ies) freezes. In some embodiments, freezable liquid drawn out of each mold by the suction may be circulated back into the ice mold cavity, while in some embodiments the freezable liquid drawn out of the mold may be directed away from the mold and replaced by additional freezable liquid.

Generally, the direction of freezing of the freezable liquid is controlled so that the freezable liquid remaining in the mold cavity freezes in a direction toward the location(s) from which the portion of freezable liquid is drawn from the cavity. As a freezable liquid, containing air bubbles and/or other impurities, freezes and advances a solid-liquid interface between the frozen freezable liquid and the liquid freezable liquid, the advancing solid-liquid interface pushes the impurities in the liquid. As long as a portion of the freezable liquid remains liquid and that portion does not become oversaturated with the impurities, the advancing solid ice remains substantially impurity free. In the context of a sealed ice mold, the impurity-laden liquid portion of the freezable liquid will eventually freeze, thereby entrapping the impurities in the ice and making the completely frozen ice shape cloudy.

As disclosed herein, the direction of freezing is controlled to be in the direction of the suction location(s). By drawing at least a portion of the liquid freezable liquid in front of the advancing solid-liquid interface out of the mold cavity during freezing, the increasing amount of impurities pushed by the advancing ice in the remaining liquid are drawn out of the mold cavity, with the drawn-off liquid being replenished in order to keep the mold cavity completely full. As the advancing solid-liquid interface continues to advance, the portion of the freezable liquid in the mold cavity becomes smaller and smaller, and at some point, all of the freezable liquid within the mold cavity freezes. Since the vast majority of the impurities pushed along by the advancing solid-liquid interface are removed by the suction/replenishment scheme, there are few if any impurities in the small volume of liquid in the mold cavity that eventually freezes. The result is an ice substantially or completely free of impurities and associated cloudiness.

In some embodiments, the freezable liquid in each ice mold cavity may be forced to increasingly freeze from the bottom and all sides inwardly and upwardly, and the very top where the suction is applied is the last portion to freeze. In some embodiments, the suction need not be applied at the top of the mold cavity and, correspondingly, the direction of the freezing need not be toward the top of the mold cavity. In some embodiments, thermal insulation, i.e., one or more materials provided intentionally to thermally insulate one or more portions of the ice mold(s) so as to control the freezing of the freezable liquid within the ice mold cavity, is not needed to control freezing. However, care may need to be taken when locating an ice mold close to a thermally insulated wall of a freezer unit in certain embodiments. Additionally, when a freezable-liquid reservoir (see below) containing freezable liquid for replenishing the portion of freezable liquid drawn from a mold cavity by the suction is provided above the ice mold, circulating freezable liquid constantly in the freezable liquid reservoir above the mold cavity (or cavities), and/or using a heating element in the reservoir, may be used to prevent the freezable liquid in that reservoir from freezing solid; a heating element may also be used to thaw the reservoir if it freezes. In some embodiments, it may be necessary to thermally insulate the outlet and/or outlet structures proximate the top of each mold and/or any conduit(s) (tube(s)) connected thereto.

In some aspects, the present disclosure is directed to icemakers that can create solid clear ice shapes in accordance with one or more aspects of the methodologies described above. The ice-shape embodiments of the present disclosure are able to be created as crystal clear, solid, and dense and can be any geometric or other shape. In some embodiments, an icemaker may be configured to use interchangeable ice molds of differing shapes and sizes. In some embodiments, an icemaker may be configured for making one or more ice shapes in a manual manner or an automated manner. For example, a manual icemaker of the present disclosure may require manual filling, manual placement into and removal from a freezer compartment of a domestic or commercial freezer, and manual removal of the ice shape(s) from the mold cavity(ies). In some embodiments, a manual icemaker may be battery powered, for example, by one or more batteries. An automatic icemaker of the present disclosure may include one or more automated features, such as automated filling of the mold cavity(ies) with a freezable liquid, automated control of the suction device(s) used to draw necessary suction and/or replenishment system for replenishing freezable liquid drawn out of the mold cavity(ies), and automated removal of the finished ice shape(s) from the mold cavity(ies). These foregoing and other aspects are described below in detail.

FIG. 1 illustrates an example icemaker 100 that makes one or more clear ice shapes (not shown) in accordance with aspects of this disclosure. For simplicity, in this example the icemaker 100 includes a single ice mold 104 containing a single mold cavity 104A that, during use of the icemaker, is filled with a freezable liquid (not shown). In other embodiments, an icemaker of this disclosure may have more than one ice mold and each ice mold may have more than one mold cavity. Examples of freezable liquids that can be used with an icemaker of the present disclosure, such as the icemaker 100, appear above. The shape of the mold cavity 104A has the shape and size of the desired clear ice shape. Generally, the shape of the mold cavity 104A is fundamentally unlimited. However, desirable shapes for chilling drinks include spheres, cubes, rectangular prisms, cylinders, and ovoids, among others. The size of the mold cavity 104A is generally limited only by practicality of use and aesthetic desirability, if any.

The icemaker 100 also includes a suction device 108 that is in fluid communication with the mold cavity 104A so as to draw a portion of the freezable liquid out of the mold cavity during the process of forming an ice shape (not shown) within the cavity. Although a single suction device 108 is illustrated, more than one suction device may be used. Accompanying the suction device 108 is a suitable replenishment system 112 that replenishes the portion of the freezable liquid drawn out of the mold cavity 104A. Each of the suction device 108 and replenishment system 112 are in fluid communication with the mold cavity 104A in any manner suitable to effect the goal of eliminating the formation of cloudy regions within the final clear ice shape caused by trapped air bubbles and any other impurities.

In some embodiments, the mold cavity 104A has an upper end and a lower end, and each of the suction device 108 and the replenishment system 112 is in fluid communication with the mold cavity at or proximate to its upper end. However, in some embodiments, one or both of the suction device 108 and the replenishment system 112 may be in fluid communication with the mold cavity 104A in another location, such as at the bottom of the mold cavity or on one or more lateral sides of the mold cavity. As long as the location(s) at which each of the suction device 108 and the replenishment system 112 allow them to provide the necessary functionalities, their location(s) may vary. Examples of manners in which each of the suction device 108 and the replenishment system 112 may be in fluid communication with the mold cavity 104A are described below in connection with FIGS. 3A to 3C. In addition, some embodiments may include multiple suction locations and/or multiple replenishment locations per mold cavity 104A.

The suction device 108 may be any suction device capable of performing the function of drawing a portion of the freezable liquid out of the mold cavity 104A during the freezing process. Examples of suction devices suitable for use as suction device 108 includes centrifugal pumps, axial flow pumps, and positive-displacement pumps, among others. Fundamentally, there is no limitation on the type(s) of suction device 108 provided as long as it/they provide the requisite amount of suction.

The replenishment system 112 may be any replenishment system capable of performing the function of replacing the portion of the freezable liquid that the suction device 108 draws out of the mold cavity 104A. In some embodiments, the replenishment system 112 is configured to recirculate, back to the mold cavity 104A, the freezable liquid that the suction device 108 draws out of the mold cavity. Such recirculation can take any of a variety of forms, including the suction device 108 discharging the drawn-out freezable liquid into an optional freezable-liquid reservoir 112A and allowing the freezable liquid to flow from the freezable-liquid reservoir into the mold cavity. In some instantiations and when provided, the freezable-liquid reservoir 112A may be located at an elevation relative to the mold cavity 104A above the mold cavity. In this case, the freezable liquid may flow from the freezable-liquid reservoir 112A largely under the force of gravity. In some instantiations, such as when the highest point of the freezable liquid in the freezable-liquid reservoir is located lower than the elevation of the top of the mold cavity 104A, the replenishment system 112 may include a pump (not shown) for assisting with moving freezable liquid from the freezable-liquid reservoir 112A to the mold cavity. In some embodiments, the freezable-liquid reservoir 112A may include a heater 112A(1) to inhibit the freezable liquid from freezing. In some embodiments in which the ice mold is located in a freezer cavity (not shown), the freezable-liquid reservoir 112A may be located either inside or outside of the freezer cavity. As another example, recirculation may take the form of a closed conduit (not shown) that directs effluent of the suction device 108 back to the mold cavity 104A. In some embodiments, the portion of the freezable liquid that the suction device 108 draws out of the mold cavity 104A is not recirculated. For example, the suction device 108 may discharge the freezable liquid it draws out of the mold cavity 104A to a drain line or other location. If the freezable liquid is not recirculated, the freezable liquid within the mold cavity 104A may be replenished from an external source. In the example of the freezable liquid being water, the icemaker 100 may include a makeup water line (not shown) connected to a suitable source of makeup (i.e., replenishment) water.

Referring now to FIGS. 2A to 2E, these figures illustrate a detailed example of the functions of the suction device 108 and the replenishment system 112 in the process of forming a clear water-ice sphere 200 (fully formed in FIG. 2E) having a diameter of 2.5 inches (64 cm) using the icemaker 100 of FIG. 1. This example utilizes a conventional freezer cavity (e.g., freezer cavity 122A of FIG. 1) into which the ice mold 104 (FIG. 1) is placed, and the air temperature in the freezer is 0° F. (−17.8° C.). Also in this example, the mold cavity 104A is virtually completely surrounded by the 0° F. (−17.8° C.) air in the freezer cavity. The ambient air pressure in this example was about 1 atmosphere.

Figures 2A, 2B, 2C, 2D, 2E:
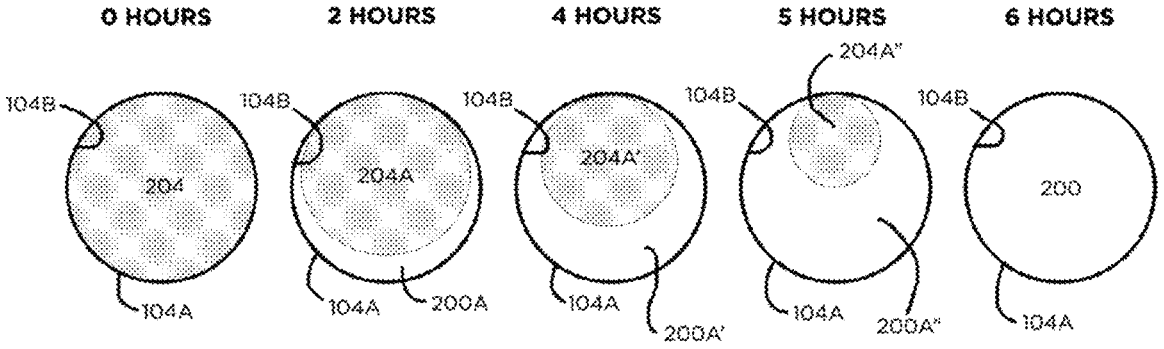
FIGS. 2A to 2E are meridional cross-sectional views of an example spherical mold cavity during differing stages of freezing of freezable liquid within mold cavity, showing a liquid core diminishing in size during the freezing process.

FIG. 2A shows the contents of the mold cavity 104A at zero hours, i.e., when the liquid water 204, which had an initial temperature of about −5° F. (−21° C.), was initially placed in the freezer compartment at time T=0 hours. As can be seen in FIG. 2A, at T=0 hours, the mold cavity 104A contains only liquid water. After 2 hours in the freezer compartment, i.e., T=2 hours and as seen in FIG. 2B, an ice shell 200A of completely clear water ice has formed in the mold cavity 104A adjacent to the interior wall 104B of the ice mold 104 (FIG. 1), while a liquid-core region 204A remains containing only liquid water. FIGS. 2C and 2D show, respectively, the increasing thickness of the ice shell 200A' and 200A" and the commensurately decreasing size of the liquid-core region 204A' and 204A" at times T=4 hours and T=5 hours, respectively. It is noted that the sizes of the liquid-core regions 204A, 204A', and 204A" relative to one another and to the overall size of the mold cavity 104A are in scale with one another. After 6 hours of time in the 0° F. (−17.8° C.) air of the freezer cavity, the clear water-ice sphere 200 has frozen completely solid, i.e., without any liquid core region remaining. At 6 hours, the sold clear-water-ice sphere 200 was completely solid and completely clear, i.e., devoid of cloudiness that, in the absence of the drawing and replenishment of the liquid water from and to the mold cavity 104A, would have been present in the ice sphere that the mold cavity would have produced under the same temperature conditions. As those skilled in the art of ice making would appreciate, without the drawing and replenishment functionalities of the suction device 108 (FIG. 1) and the replenishment system 112 (FIG. 1), the completely frozen resulting water-ice sphere (not shown) would include at least one cloudy region at the location where the gradual inwardly progressing freezing of the liquid water pushes the air bubbles and the air bubbles become trapped within the ice sphere.

Figure 3A:
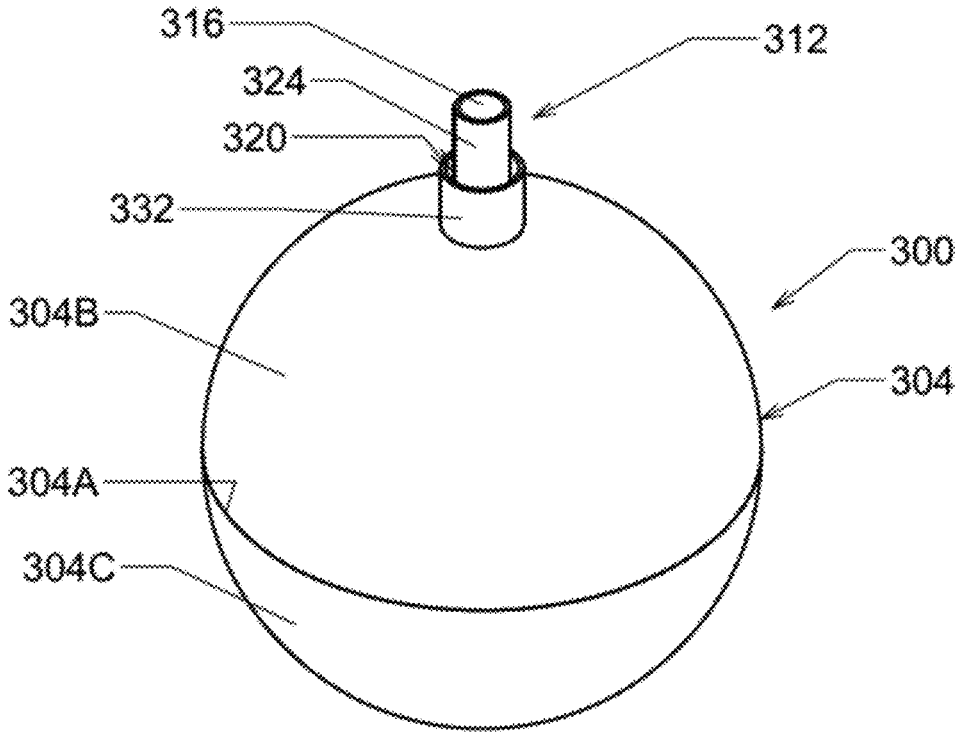
FIG. 3A is an isometric elevational view of an example embodiment of the mold of FIG. 1 (and also FIGS. 2A to 2E) having a single spherical mold cavity and a concentric outlet-inlet structure for drawing a portion of freezable liquid out of the mold cavity and simultaneously replenishing the drawn-out freezable liquid.
Figure 3B:
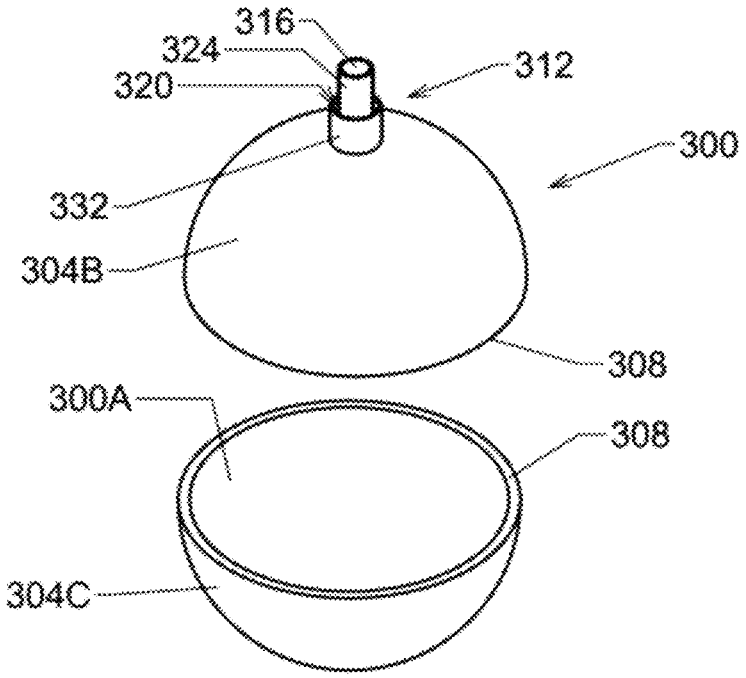
FIG. 3B is an isometric exploded view of the mold of FIG. 3A, showing the upper and lower body portions separated from one another.

FIGS. 3A and 3B illustrate an example ice mold 300 that is an embodiment of the ice mold 104 (see FIG. 1) used in the experiment illustrated in FIGS. 2A to 2E. Referring to FIGS. 3A and 3B, in this embodiment the ice mold 300 comprises a generally spherical body 304 having a uniformly thick wall 308 that defines the largely spherical mold cavity 300A. In this embodiment, the body 304 is made of silicone rubber. However, in other embodiments, the body may be made of any one or more other suitable materials. Here, the body 304 is split horizontally at a joint 304A along an equatorial plane to provide an upper body portion 304B and a lower body portion 304C sealingly and removably engaged with the upper body portion, via the joint, during the process of forming a solid clear ice sphere, such as solid clear water-ice sphere 200 of FIG. 2E. One, the other, or both, of the upper and lower body portions 304B and 304C can be moved relative to one another to allow the ice mold 300 to be opened, for example, to remove the solid clear ice sphere, here, solid clear water-ice sphere 200. Joint 304A may be of any suitable type, such as a friction-fit joint, a screw joint, a latched joint, among others.

In the embodiment of FIGS. 3A and 3B, the ice mold 300 includes an integral concentric outlet-inlet structure 312 attached to the wall 308 at the top center of the ice mold 300. As better seen in FIG. 3C, the concentric outlet-inlet structure 312 has a central outlet flow passageway 316 and an inlet flow passageway 320 located concentrically around the central flow passageway. In this example, the central flow passageway 316 is defined by an inner conduit 324 that, if deployed in icemaker 100 of FIG. 1, would be in fluid communication with the suction device 108 and the mold cavity 300A so as to facilitate the drawing of the freezable liquid, here, liquid water 204, out of the mold cavity 300A during the freezing process, as represented by flow arrow 328. In this embodiment, the outer flow passageway 320 is located between an outer conduit 332 and the inner conduit 324 and is in fluid communication with a source of freezable liquid, here, water 204, as part of the replenishment system 112 (FIG. 1), and the mold cavity 300A so as to facilitate replenishment of the liquid water that the suction device 108 (FIG. 1) draws out of the mold cavity during freezing. The replenishment flow of the liquid water 204 (FIG. 2A) is represented in FIG. 3C by flow arrows 336.

Figure 3C:
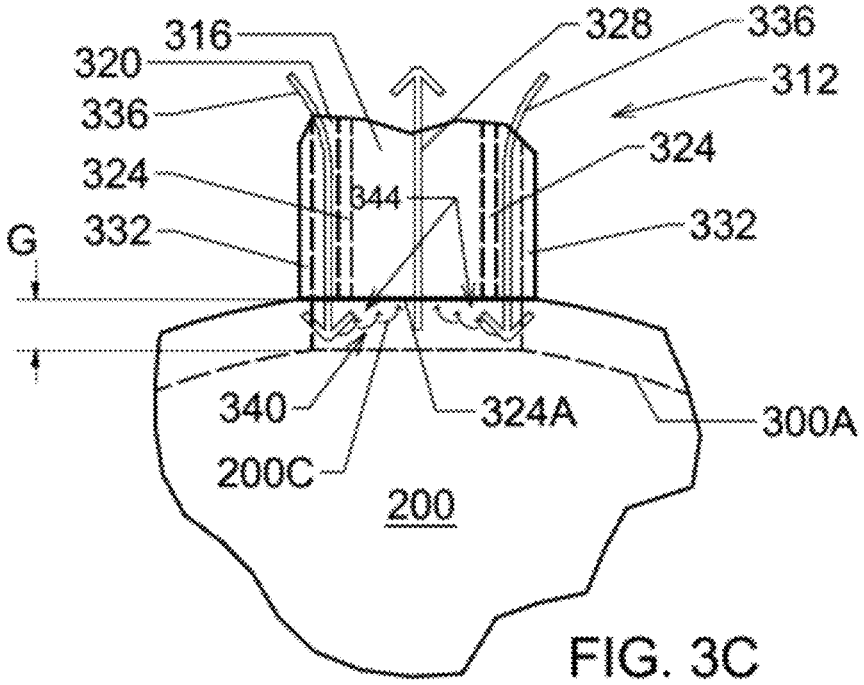
FIG. 3C is an enlarged partial view of the example embodiment of FIG. 3A illustrating an example flow profile in the freezable liquid once the clear water ice sphere has completely frozen.

With continued reference to FIG. 3C, the mold cavity 300A is shown with the solid clear water-ice sphere 200 as being fully formed and with the suction device 108 (FIG. 1) and the replenishment system 112 (FIG. 1) still operating. In this embodiment, the continuing operation of the suction device 108 and the replenishment system 112 is represented by flow arrows 340 that show that the replenishment flow 336 from the replenishment system is immediately drawn away by the drawing flow 328 of the suction device by virtue of the end 324A of the inner conduit 324 being spaced from the upper end 200C of the fully frozen clear water-ice sphere 200. It is noted, however, that the replenishment flow 336 as shown is not necessarily representative of the flow within the liquid-core region 204A, 204A', and 204A" (FIGS. 2B to 2D) at its various stages of its existence. Rather, the replenishment flow 336 may run deeper within the liquid-core region 204A, 204A', and 204A" (FIGS. 2B to 2D) to include more turbulent flow and/or mixing of the replenishment flow with the preexisting freezable liquid, here, water, already within the liquid-core region.

In the embodiment of FIG. 3C, the gap, G, between the end 324A of the inner conduit 324 and the upper end 200C of the fully frozen clear water-ice sphere 200 provides a bypass 344 that allows the liquid water to continue to flow from the replenishment system 112 (FIG. 1) to the suction device 108 (FIG. 1) (see arrows 340) even when the clear water-ice sphere 200 is completely frozen as illustrated in FIG. 3C. However, a bypass, such as the bypass 344 of FIG. 3C, is not needed for all of the freezable liquid within a mold cavity to freeze solid, since, at least as long as the velocities of the suction and replenishment flows are relatively small, even the flow within a mold cavity between a suction outlet and a replenishment inlet will eventually freeze. Some example alternative arrangements of suction outlets and replenishment inlets are illustrated in FIGS. 4A to 4C.

As those skilled in the art will readily appreciate, a feature of the design of the suction device 108 and/or the replenishment system 112 (FIG. 1) is to strike a balance of the drawing off and replenishment of the freezable liquid from and to the liquid-core region 204A, 204A', and 204A" (FIGS. 2B to 2D) with allowing the ice shell 200A, 200A', and 200A" (FIGS. 2B to 2D) to progressively freeze so as to minimize the impact of the drawing off/replenishment while achieving a clear ice shape in a reasonable or minimal amount of time. For the sake of convenience, the process of making clear ice shapes in accordance with aspects of the present disclosure is referred to as an "active-core" process, because the liquid-core region (e.g., liquid-core region 204A, 204A', and 204A" (FIGS. 2B to 2D)), when it exists during the middle stages of forming a completely frozen clear ice shape, is active by virtue of it being disturbed, i.e., active, by virtue of by the drawing of liquid freezable liquid therefrom by the suction device 108 and/or the replenishment of liquid freezable liquid thereto from the replenishment system 112 (FIG. 1). Without being bound to any particular theory or description of the precise flow characteristics within the liquid-core region as the ice shell 200A, 200A', and 200A" (FIGS. 2B to 2D) grows thicker, the success of the active-core process in making clear ice shapes may be, at least in part, due to the drawing-out and/or replenishment of the freezable liquid from and to the liquid-core region that keeps a liquid pathway between the advancing solid-liquid interface of the growing ice shell 200A, 200A', and 200A" (FIGS. 2B to 2D) and the suction and replenishment location(s) so that all air bubbles and/or other impurities can be removed from the cavity prior to all of the freezable liquid in the mold cavity completely freezing.

A number of variables, including the size and shape of the desired clear ice shape, the type of freezable liquid, the temperature to which the freezable liquid inside the mold cavity is exposed, and the extent to which the mold cavity is exposed to freezing temperature, may need to be considered when determining how to strike the necessary balance of allowing thickening of the ice shell (e.g., ice shell 200A, 200A', 200A" (FIGS. 2B to 2D)) while ensuring complete or substantially complete removal of air bubbles and/or other impurities. In addition, a number of parameters will typically need to be considered, such as flow rate of the suction device relative to the size of the mold cavity(ies) serviced by the suction device, size(s) and shape(s) of the suction opening(s) into each mold cavity, cross-sectional size(s) and cross-sectional shape(s) of the suction conduit(s)/passageway(s), continuousness of the operation of the suction device (e.g., continuous versus intermittent, duty cycle, etc.), manner of replenishment, and geometry(ies) of flow conduit(s)/passageway(s) of the replenishment system, among others. Those skilled in the art will be able to arrive at suitable parameters without undue experimentation using the present disclosure as a guide.

Figure 4A:
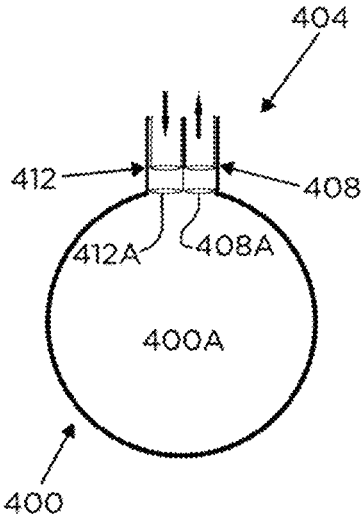
FIG. 4A is an elevational view of an ice mold having an alternative outlet-inlet structure for drawing freezable liquid from and replenishing freezable liquid to a mold cavity.
Figure 4B:
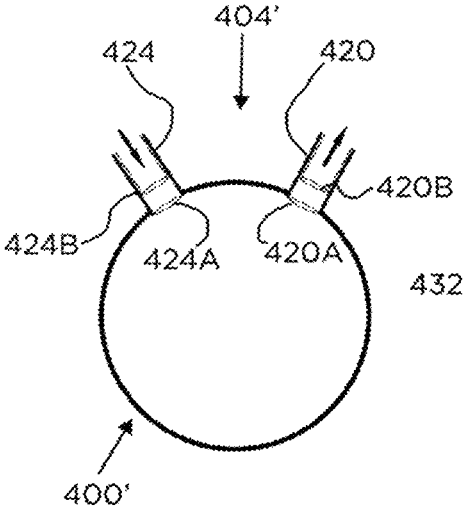
FIG. 4B is an elevational view of an ice mold having another alternative outlet-inlet arrangement for drawing freezable liquid from and replenishing freezable liquid to a mold cavity.
Figure 4C:
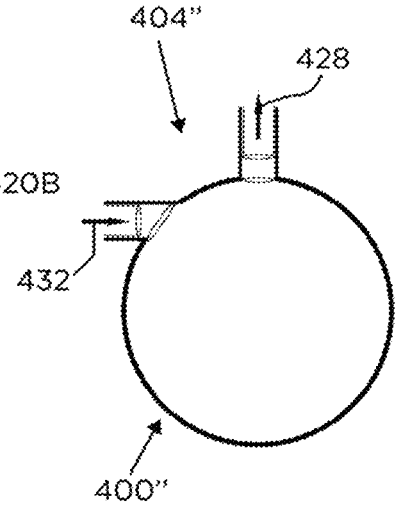
FIG. 4C is an elevational view of an ice mold having a further alternative outlet-inlet arrangement for drawing freezable liquid from and replenishing freezable liquid to a mold cavity.

FIGS. 4A to 4C illustrate, respectively, ice molds 400, 400', and 400" that have corresponding outlet-inlet structures 404, 404', and 404" that are different from the outlet-inlet structure 312 of FIGS. 3A to 3C. Referring to FIG. 4A, the outlet-inlet structure 404 includes an outlet conduit 408 and an inlet conduit 412 positioned side-by-side. The outlet conduit 408 provides a fluid passageway 408A from the mold cavity 400A to the suction device 108 (FIG. 1), and the inlet conduit 412 provides a fluid passageway 412A from a source of freezable liquid, such as the freezable-liquid reservoir 112A (FIG. 1), the suction device 108, or other source. Although FIG. 4A shows the outlet-inlet structure 404 located at the top end of the mold cavity 400A, that need not be so. Rather, the outlet-inlet structure 404 may be located at any other suitable location around the spherical mold cavity. In the embodiment of FIG. 4A, the outlet-inlet structure 404 may optionally include a bypass (not shown), for example, located immediately adjacent to the mold 400, that allows freezable liquid from the inlet conduit 412 to be drawn directly into the outlet conduit 408 when the clear ice shape (not shown) within the mold cavity 104A is completely frozen and completely spherical. It is noted that in other embodiments one, the other, or both, of the outlet and inlet conduits 408 and 412 may be eliminated, with at least a portion of the corresponding passageway(s) 408A and 412A being formed in the ice mold 400 itself. Other constructions are possible, as will be apparent to those skilled in the art.

The outlet-inlet structure 404' of FIG. 4B has an outlet conduit 420 and an inlet conduit 424 providing corresponding passageways 420A and 424A in a manner similar to the outlet and inlet conduits 408 and 412 of FIG. 4A. The embodiment of FIG. 4B illustrates that the flow axes 424B and 420B of the flow passageways 420A and 424A need not be parallel to one another as they are in each of the outlet-inlet structures 308 and 404 of FIGS. 3C and 4A, respectively. The embodiment of FIG. 4B may include an optional bypass (not shown) that may have the same purpose as bypass 344 of FIG. 3C. For example, the optional bypass may be a conduit that fluidly connects the flow passageways 420A and 424A with one another and runs along the outside top of the mold 400' between the outlet and inlet conduits 420 and 424, respectively. Other aspects of the outlet-inlet structure 404' of FIG. 4B may be the same as for the outlet-inlet structure 404 of FIG. 4A. FIG. 4C illustrates yet another variation in which the outlet-inlet structure 404" has outlet and inlet flow axes 428 and 432, respectively, that are not parallel to one another. Other aspects of the outlet-inlet structure 404" of FIG. 4C may be the same as or similar to the outlet-inlet structures 404' and 404 of FIGS. 4B and 4A, respectively, including the presence of an optional bypass.

Referring again to FIG. 1, in some embodiments, the icemaker 100 be constructed in a manner, such as a unitary manner, that allows a user to insert and remove the icemaker to and from a freezer cavity (not shown), such as a freezer cavity of a conventional freezer unit or refrigerator freezer unit. For example, if the icemaker 100 includes the freezable-liquid reservoir 112A, then the ice mold 104, the suction device 108, and the freezable-liquid reservoir may be fixedly attached to one another to form a unit, and the unit may further include a base (not shown), legs, or other suitable structure that allows the unit to stably placed into the freezer cavity. In a removable version of the icemaker 100, the icemaker may further include an integrated battery compartment 116 containing one or more batteries (only one battery 120 shown) for powering the suction device 108. In such a unit that includes the freezable-liquid reservoir 112A, a user may fill the mold cavity 104A by putting freezable liquid into the freezable liquid reservoir.

In some embodiments, the icemaker 100 may be configured to be integrated into a freezer compartment 122A, such as a freezer compartment of a freezer 122 of either a domestic type or a commercial type. In such embodiments, the suction device 108 may be hardwired to power circuitry within the freezer or refrigerator-freezer unit, and the icemaker 100 may optionally include one or more systems for automating the operation of the icemaker. For example, in such integrated embodiments, the icemaker may include an autofill system 124 designed and configured to automatically fill the mold cavity 104A and/or the freezable-liquid reservoir 112A (if provided) with a freezable liquid after the complete formation and removal of a clear ice shape from the mold cavity. If the freezable liquid is water, in some embodiments the autofill system 124 may be fluidly connected to a pressurized source of water and include an electronically controlled valve (not shown) and one or more sensors and/or timers for controlling the operation of the electronically controlled valve. The autofill system 124 may include its own controller (not shown) for controlling the autofill system, and/or the icemaker 100 may have a master controller 128 for controlling the autofill system and other automated aspects of the icemaker.

In some embodiments, the icemaker 100 may include an auto-release system 132 that automatically unloads a finished clear ice shape from the mold cavity 104A. If provided, the auto-release system 132 may include a heater 132A that heats the ice mold 104 adjacent to the mold cavity 104A to free the clear ice shape from the ice mold. The auto-release system 132 may also or alternatively include an opening-closing system 132B that opens the ice mold 104 for the unloading process and closes the ice mold for making another clear ice shape. The auto-release system 132 may include its own controller (not shown) for controlling the auto-release system, and/or, as noted above, the icemaker 100 may have the master controller 128 for controlling the auto-release system and other automated aspects of the icemaker.

In some embodiments, the ice mold 104 may be interchangeable with another ice mold (not shown), such as an ice mold having a mold cavity having a shape different from the shape of the mold cavity of the ice mold 104. In some embodiments, the icemaker 100 may include an ice bin 144 for holding finished clear ice shapes unloaded from the ice mold. Depending on the design, the ice bin 144 may be integral with, removably engaged with, or separate from other components of the icemaker 100. It is noted that while many of the components of the example icemaker 100 are described and shown in the singular, in other embodiments more than one of each type of component may be provided. For example, instead of a single mold cavity 104A, multiple mold cavities may be provided. Similarly, multiple ice molds and/or multiple suction devices may be provided. In addition, multiple suction outlets and/or multiple replenishment inlets may be provided for each mold cavity. Those skilled in the art will readily understand the many variations of the icemaker 100 that are possible and that are within the capability of someone of ordinary skill in the art to make.

In some embodiments, the icemaker 100 may optionally include its own freezing system 136, which may include any suitable device(s) 136A needed to apply freezing temperatures to the freezable liquid within the mold cavity 104A, such as a compressor, a condenser, a thermal expansion valve, an evaporator, and/or one or more thermoelectric coolers, among others. In some embodiments, the ice mold 104 may include internal cooling passageways (not shown) that eliminate the need to place the ice mold in a freezer compartment. In some embodiments that include the freezing system 136, the icemaker 100 may be embodied as a standalone unit. The freezing system 136 may include a dedicated controller (not shown), and/or the freezing system may be under at least partial control of the master controller 128, if provided.

If included, the master controller 128 may be in operative communication with one or more sensors 140 and/or include one or more timers (not shown) for controlling one or more operations of the icemaker 100. The one or more sensors 140 may include one or more temperature sensors for sensing one or more temperatures within the icemaker 100, such as the temperature of the freezable liquid at one or more locations, one or more liquid-level sensors, for example, to sense the level of the freezable liquid in the freezable-liquid reservoir 112A (if present), one or more fullness sensors to sense the fullness of the ice bin 144 (if present), and/or one or more other types of sensors. Those skilled in the art will understand how to deploy and use any sensors implemented for a particular design.

The master controller 128 may also or alternatively be in operative communication with one or more components of each of any other systems provided, such as the autofill system 124 and/or the auto-release system 132, so as to control such component(s). For example, the master controller 128 may be in operative communication with a valve, pump, or other device of the autofill system 124 and/or in operative communication with one or more actuators of the opening-closing system 132B, among others. In some embodiments, the master controller 128 may be implemented digitally via one or more microprocessors and associated physical memory(ies), which may be implemented using any suitable architecture, such as a system on chip or a motherboard architecture. The master controller 128 may be controlled by suitable software (i.e., machine-executable instructions) stored in the physical memory(ies). In some embodiments, the master controller 128 may include one or more user interfaces 128A that allow a user to control the operation of the icemaker 100, in some embodiments including selecting one or more operating parameters of the icemaker, such as operating conditions and/or production output, among others. Such user interface(s) 128A may be accessible to a user in any suitable manner, such as one or more input/output devices, including hard buttons, touch-screen devices, laptop computers, tablet computers, smartphones, etc.

If automatic release and storage of ice shapes is desired, one or more of a number of features may be provided. For example, before extraction, action may be taken to prevent liquid water from escaping through the ice mold 104 when it is opened, for example, by either sealing off the water reservoir 112A (if present) from the ice mold with a valve (not shown) or similar device, by allowing freezable liquid in the inlet flow passageway 316 (FIGS. 3A and 3B) to freeze solid to block the flow of the freezable liquid, or by removing any freezable liquid first. Also and as noted above, action may be taken to release the clear ice shape from the ice mold 104, for example, by the auto-release system 132. After release, action may be taken to capture each clear ice shape in a way that places it into the ice bin 144 without damaging the released clear ice shape or others that may be already in storage. For example, a narrowing flexible mesh tube (not shown) may be used to slow the speed of each clear ice shape falling from the open ice mold 100. This may be especially useful for relatively large and heavy clear ice shapes to avoid damaging them.

Figure 5:
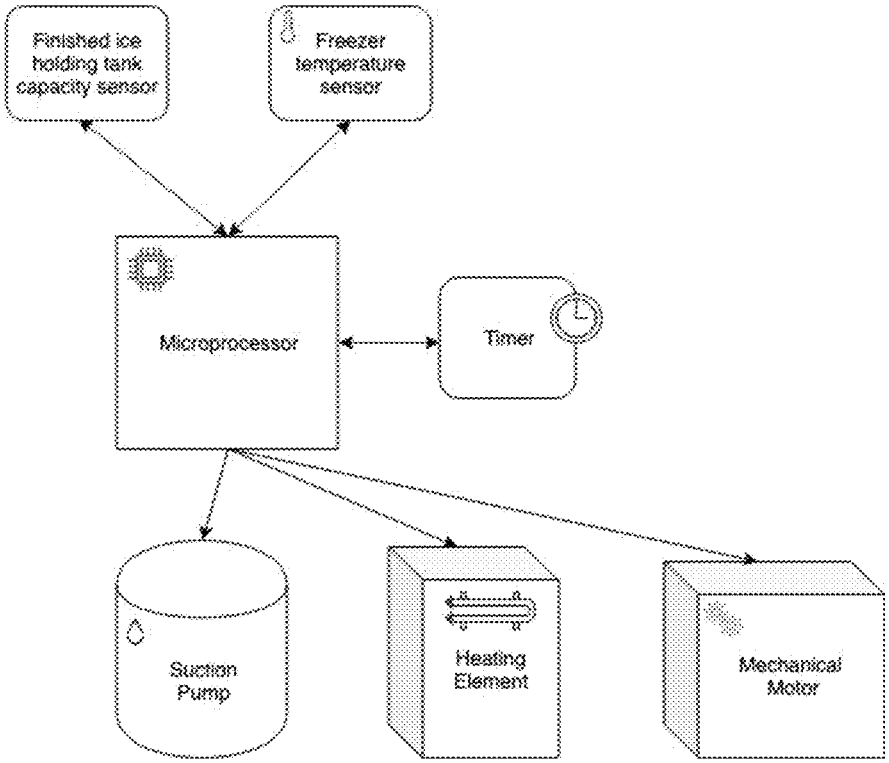
FIG. 5 is a diagram illustrating using a microprocessor to function as the master controller of FIG. 1 to control various operations of an icemaker.

Referring to FIG. 5, and also to FIG. 1, FIG. 5 illustrates an example in which the master controller 128 (here, "Microprocessor") is used to control the suction device 108 (here, "Suction Pump"), the heater 132A (here, "Heating Element") of the auto-release system 132, and the opening-closing system 132B (here, "Mechanical Motor") of the auto-release system. In this example, the sensors 140 include a fullness sensor (here, "Finished ice holding tank capacity sensor") for the ice bin 144, a temperature sensor (here, "Freezer temperature sensor"), and a "Timer" for measuring the passage of time. In this example, the Microprocessor uses the Timer to determine when the ice shape(s) that the icemaker 100 makes are fully frozen so that the Microprocessor can determine when to actuate the Heater and then the Mechanical Motor of the auto-release system 132. The Microprocessor can use an algorithm that uses the temperatures sensed by the "Freezer temperature sensor" to determine the time it takes for the ice shape(s) to fully freeze. The Microprocessor may use the Finished ice holding tank capacity sensor to determine when the ice bin 144 is full. If the Finished ice holding tank capacity sensor is sensing that the ice bin is full, the Microprocessor will not activate the auto-release system 132 despite the ice shape(s) being completely frozen. After ice has been removed from the ice bin 144 so that the Finished ice holding tank capacity sensor no longer senses that the ice bin is full, the Microprocessor will then activate the auto-release system 132 to release the fully frozen ice shape(s) from the mold(s) 104.

Figure 6:
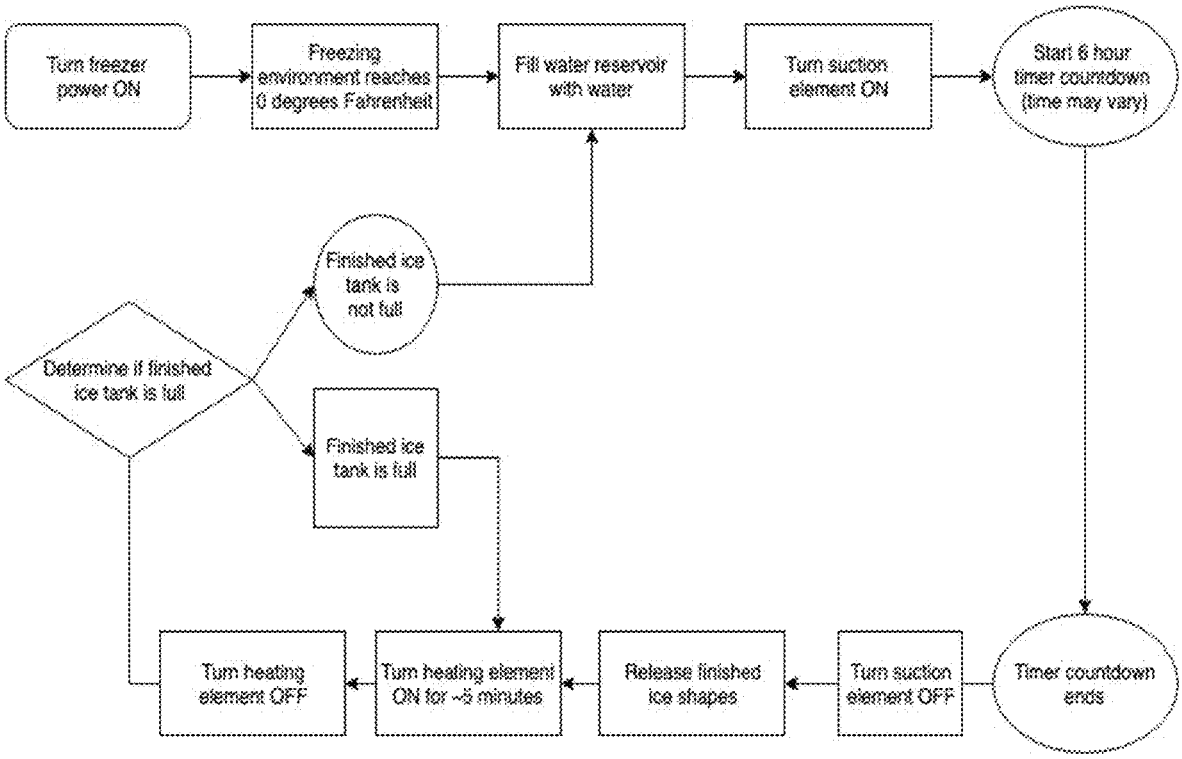
FIG. 6 is a flow diagram of an example method of controller operation of an icemaker of the present disclosure, such as an icemaker made in accordance with FIG. 1.

Referring to FIG. 6, and also to FIG. 1, FIG. 6 illustrates an example method of operating embodiments of the icemaker 100 of FIG. 1 using water as the freezable liquid. The steps of the method of FIG. 6 may be as follows.

1) A freezing device (e.g., a domestic or commercial freezer) is turned on and set to, for example, −10 degrees Fahrenheit.

2) Once −10 degrees is reached, the ice mold cavity/cavities 104A are filled with water from above water reservoir 112A.

3) The suction pump (suction device 108) is turned on and continuously pulls water from the top of each cavity 104A via the suction tube(s) (see, e.g., the suction conduit 324 of FIG. 3C) and releases that water into the water reservoir 112A for the entire duration of the freezing process.

4) Water freezes for some amount of time (in one example ~6 hours, but this will vary with application, including but not limited to icemaker configuration, size and shape of ice being created, and freezing environment). The conclusion of the freezing process may be determined by a countdown timer (see, e.g., the Timer of FIG. 5) set for a specific amount of time, a sensor, e.g., one of the sensors 140) that can determine when the suction pump 108 is no longer pulling water and is frozen, or another method.

5) After a set time, a mechanical system (not shown) is activated to seal off the reservoir from the mold cavities, then open the ice mold cavity(ies) 104A in two halves and release the finished ice shapes into the ice bin 144, funnel device, or other device, such as a tapered mesh tube, to carefully lower the finished ice shapes into the ice bin.

5A) Another way that the reservoir 112A can be sealed off from the mold cavity(ies) 104A without a mechanical system is to ensure the inlet tube is filled with solid ice above the mold cavity prior to releasing the finished ice shapes into the ice bin 144. The ice in the inlet tube serves as a "natural plug" to prevent water from leaking out of the reservoir 112A. As noted below, for the next cycle, any ice plug so formed can be melted to allow liquid water to flow again.

6) Mechanical system (see, e.g., the Mechanical Motor of FIG. 5) closes the ice mold cavity(ies) 104A.

7) Then a heater 112A(1) is turned on in the water reservoir 112A to ensure that any ice build-up in the reservoir (and in the inlet tube as described in 5A, above) is melted prior to the next batch.

8) After a predetermined amount of time when it is known that the water reservoir 112A has returned to liquid, non-frozen form, the heating element 112A(1) is turned off. This can be determined by time, a temperature sensor, or another type of sensor 140.

9) The process starts over again at step 2, above, unless a sensor (see, e.g., the Finished ice hold tank capacity sensor of FIG. 5) indicates that a lower finished ice bin 144 is full. If it is full, the heater 112A(1) is turned on until the sensor indicates that the ice bin 144 is no longer full to keep the water in the water reservoir 112A from freezing.

Figure 7A:
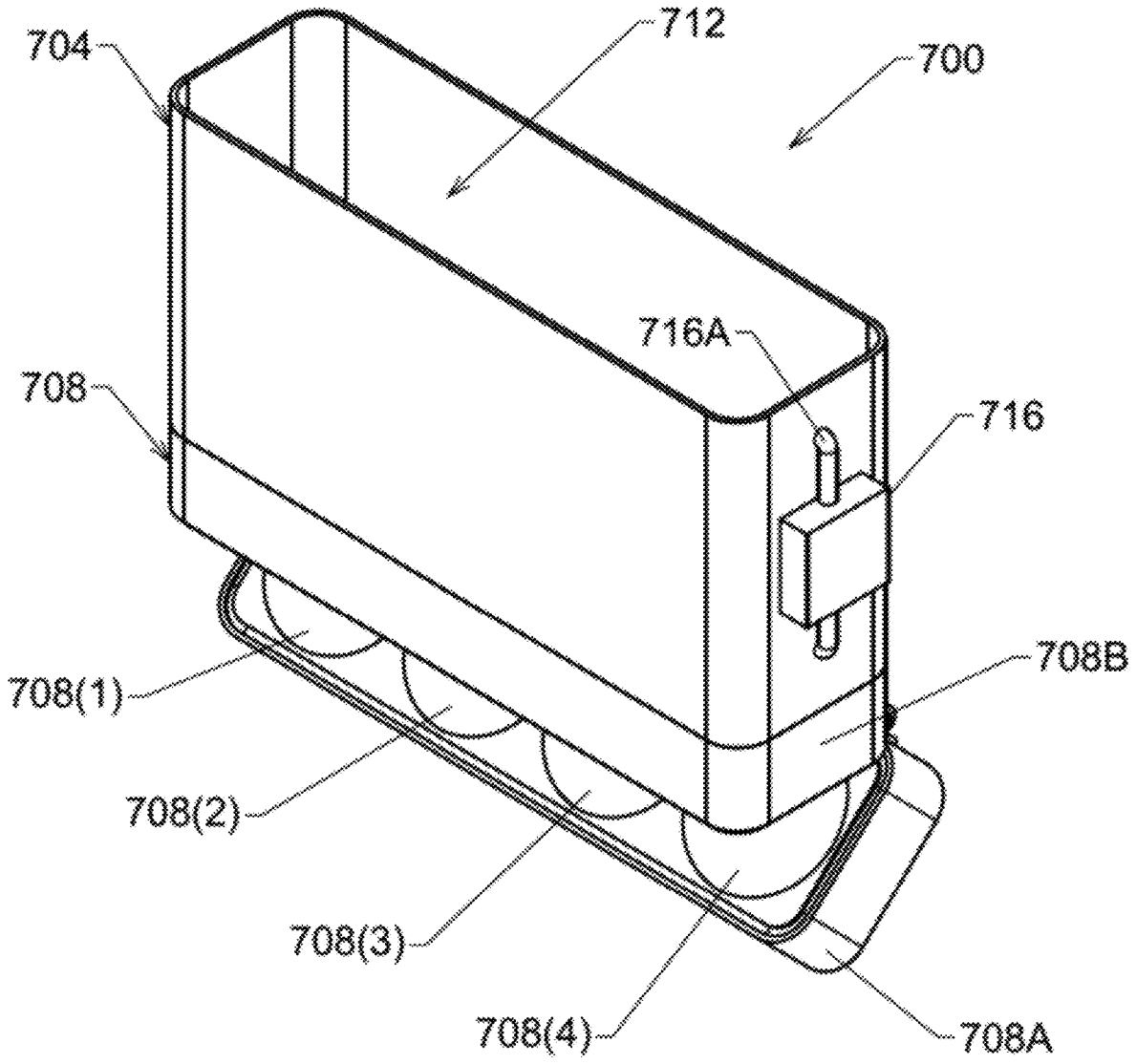
FIG. 7A is an isometric view of an example embodiment of the icemaker of FIG. 1, showing a hinged mold half open to expose interiors of the mold cavities.
Figure 7B:
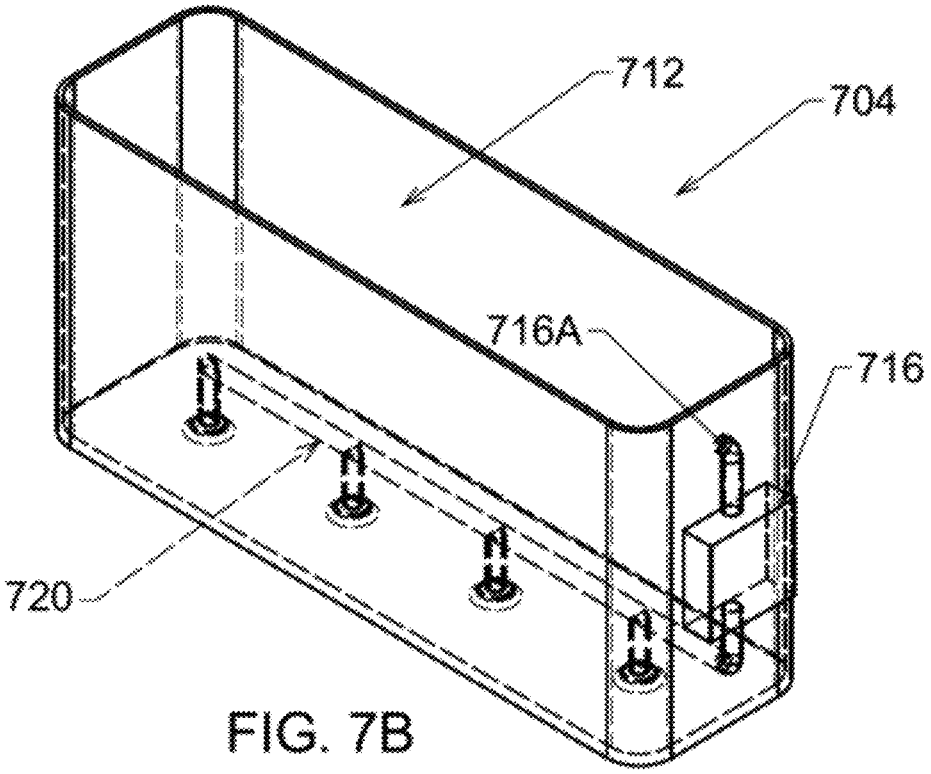
FIG. 7B is an isometric partial see-through view of the reservoir portion of the icemaker of FIG. 5A, showing the reservoir and conduits connecting the mold cavities to the suction device.
Figure 7C:
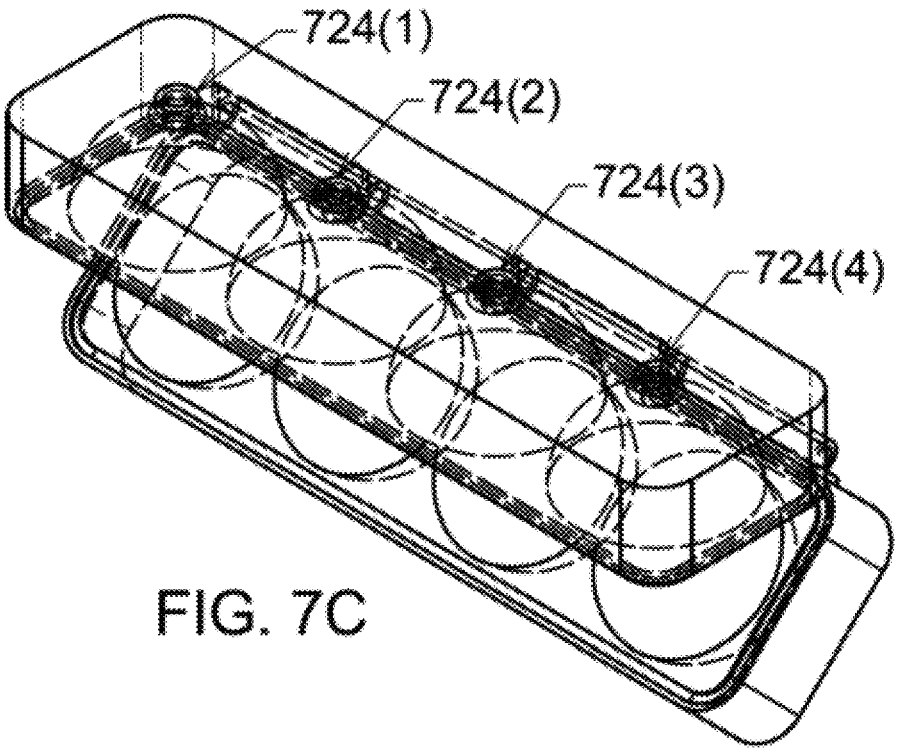
FIG. 7C is an isometric partial see-through view of the mold portion of the icemaker of FIG. 5A, showing structure of the individual mold cavities and outlet-inlet structures.
Figure 8A:
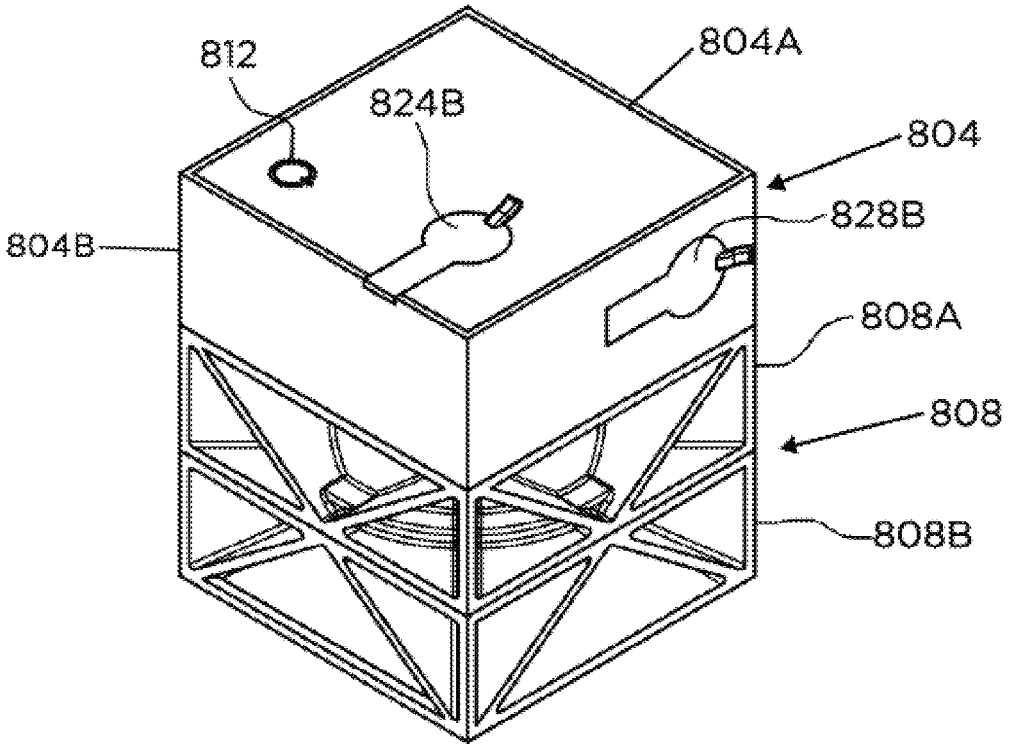
FIG. 8A is a top isometric view of another example embodiment of the icemaker of FIG. 1.
Figure 8B:
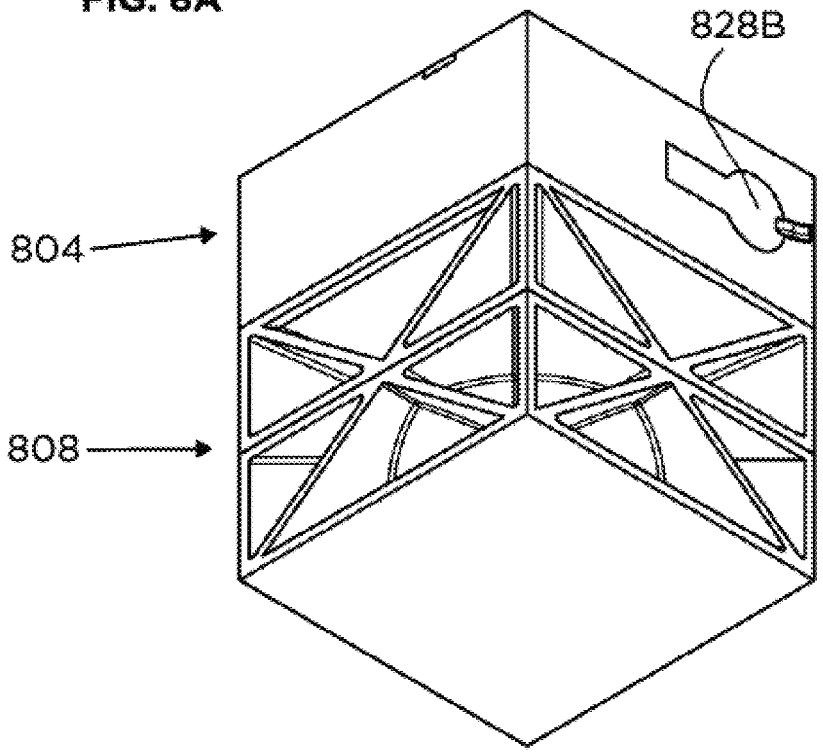
FIG. 8B is a bottom isometric view of the icemaker of FIG. 8A.
Figure 8C:
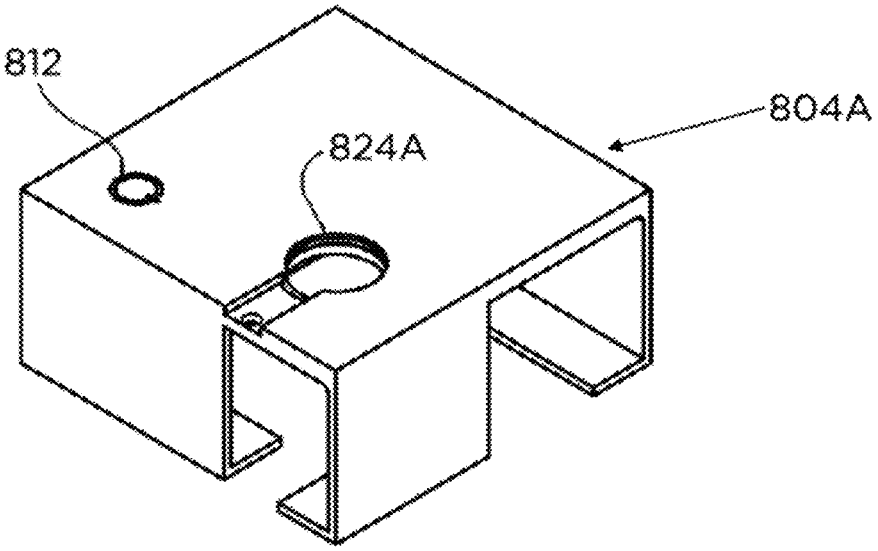
FIG. 8C is a top isometric view of a lid of the head unit of the icemaker of FIGS. 8A and 8B, showing portions removed for viewing interior components.
Figure 8D:
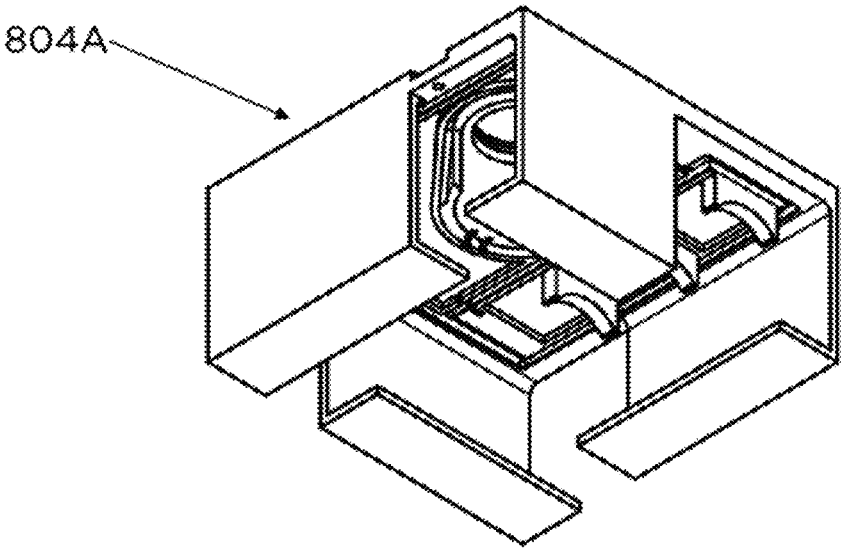
FIG. 8D is a bottom isometric view of the lid of the head unit of FIGS. 8A and 8B, showing portions removed for viewing interior components.
Figure 8E:
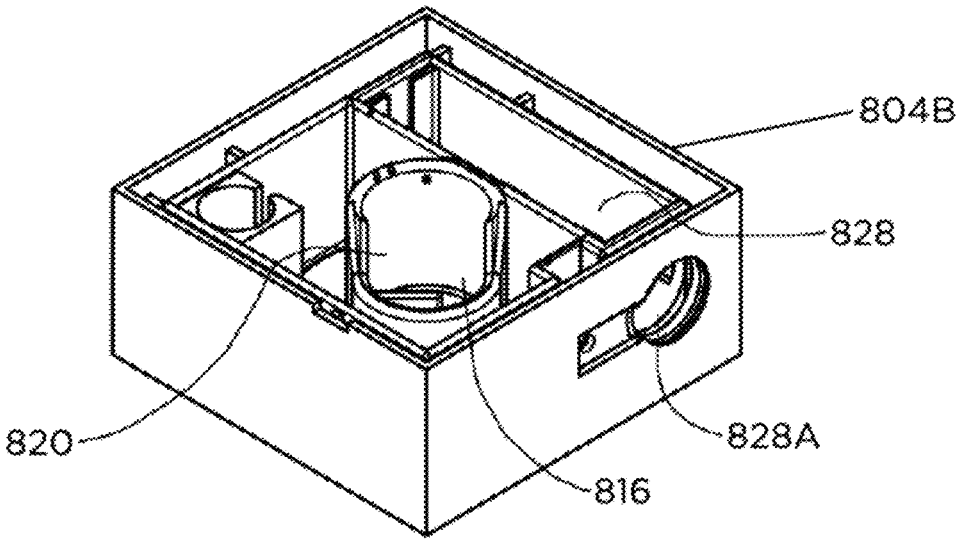
FIG. 8E is a top isometric view of a base of the head unit of the icemaker of FIGS. 8A and 8B.
Figure 8F:
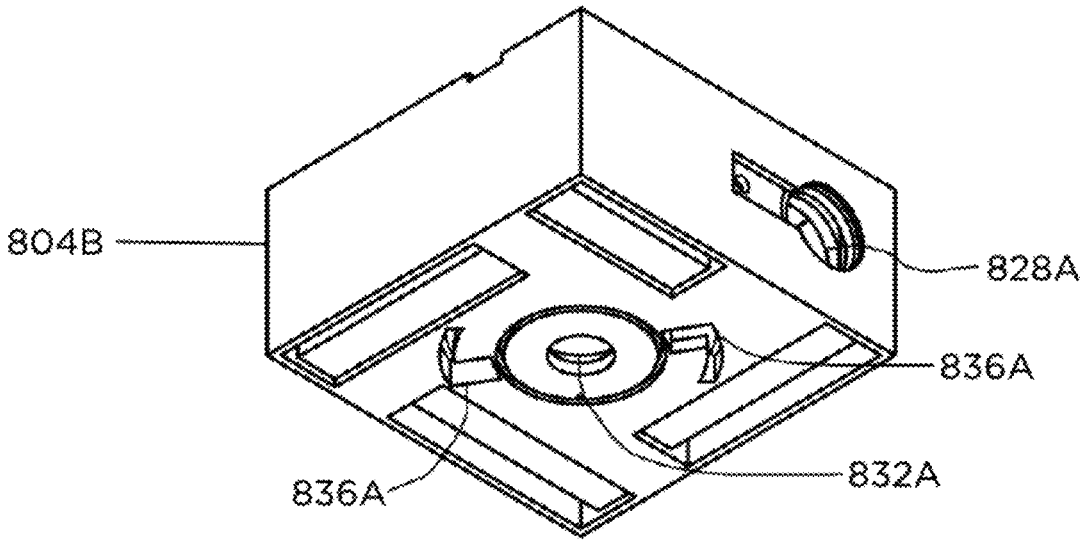
FIG. 8F is a bottom isometric view of the base of the head unit of FIGS. 8A and 8B.
Figure 8H:
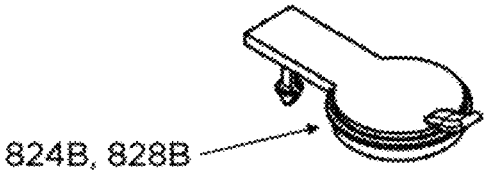
FIG. 8H is a top isometric view of the head unit of FIGS. 8A and 8B, showing the battery compartment and pump compartment closures present and in their sealing states.
Figure 8H:
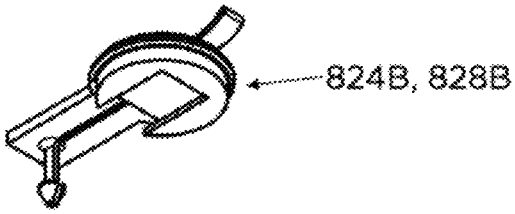
Figure 8H:
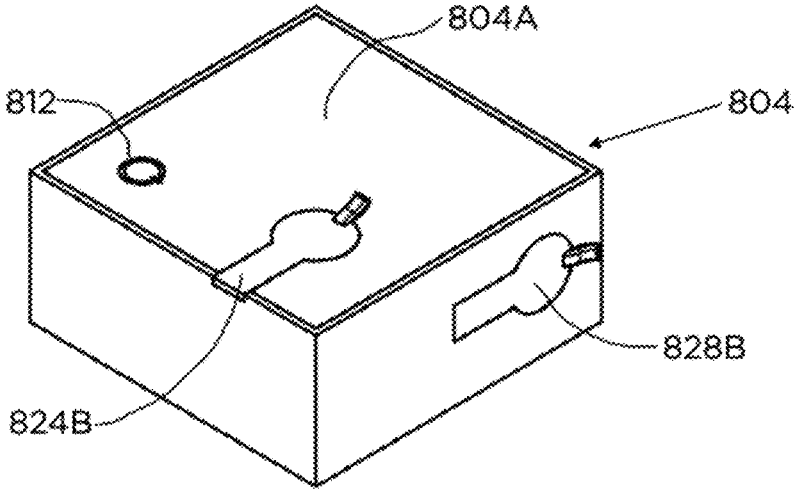
Figure 8I:
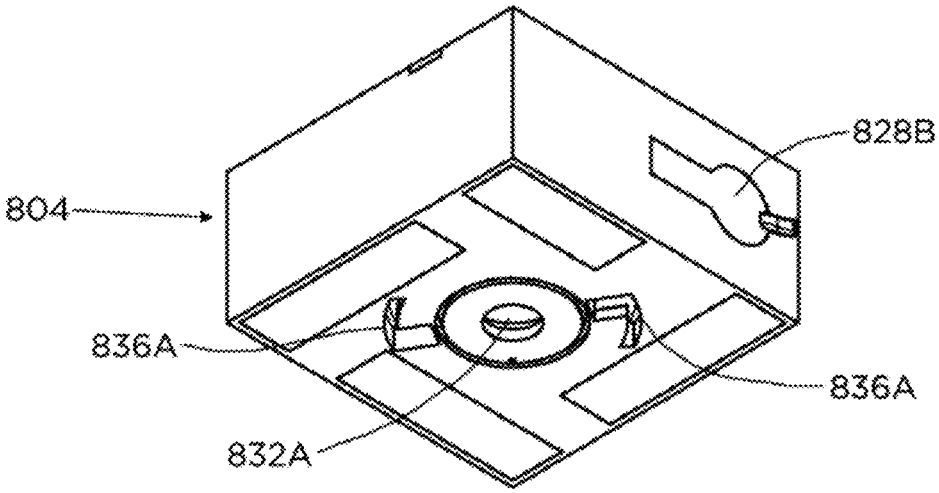
FIG. 8I is a bottom isometric view of the head unit of FIGS. 8A and 8B, showing the battery compartment closure present and in its sealing state.
Figure 8J:
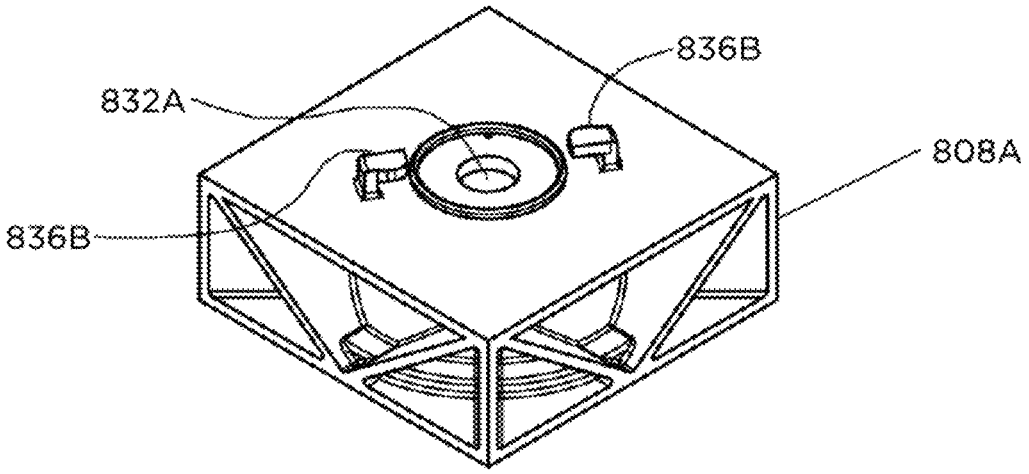
FIG. 8J is a top isometric view of the upper mold component of the mold unit of the icemaker of FIGS. 8A and 8B.
Figure 8K:
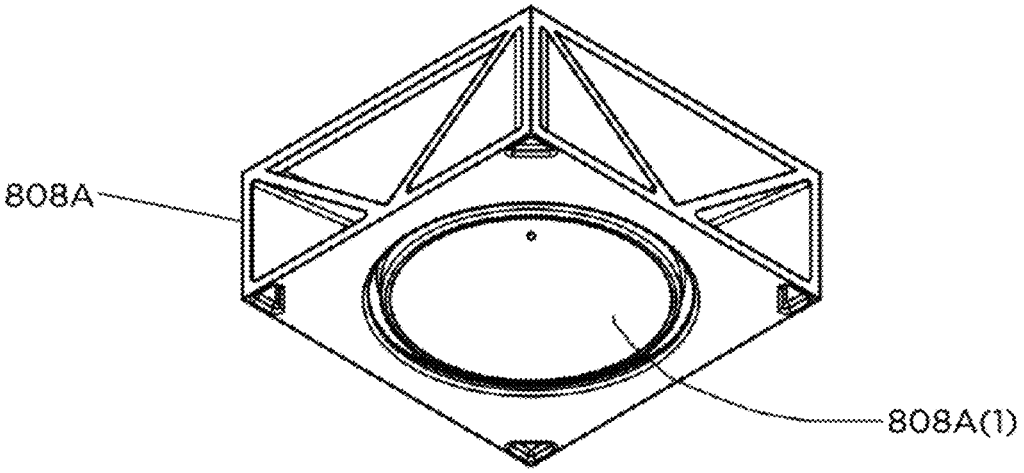
FIG. 8K is a bottom isometric view of the upper mold component of the mold unit of FIGS. 8A and 8B.
Figure 8L:
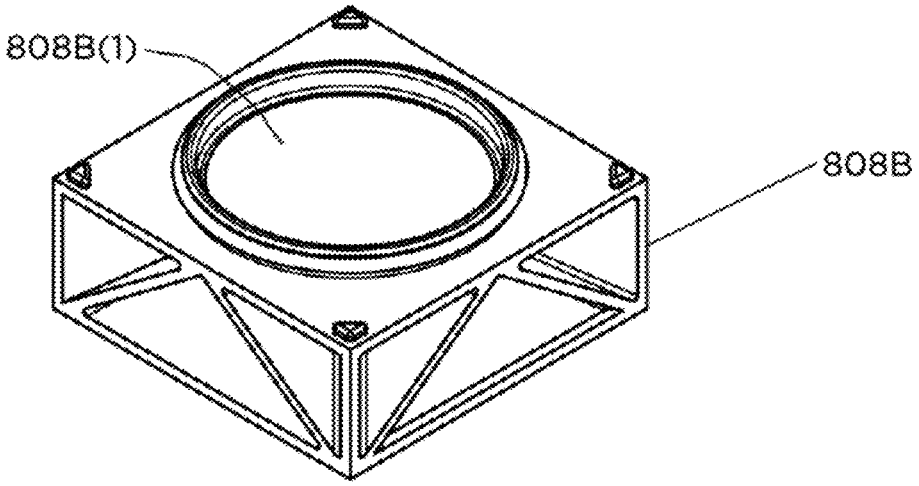
FIG. 8L is a top isometric view of the lower mold component of the mold unit of the icemaker of FIGS. 8A and 8B.
Figure 8M:
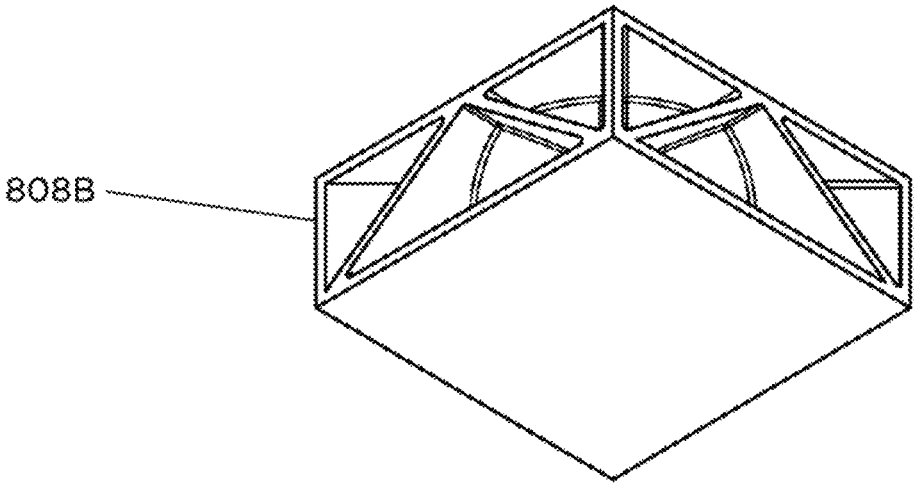
FIG. 8M is a bottom isometric view of the lower mold component of the mold unit of FIGS. 8A and 8B.

FIGS. 7A to 7C illustrate an example icemaker 700 made in accordance with aspects of the icemaker of FIG. 1. As seen in FIGS. 7A to 7C, the icemaker 700 includes an upper portion 704 and mold portion 708, which contains four spherical mold cavities 708(1) to 708(4). The upper portion includes a freezable-liquid reservoir 712 and a suction pump 716 that is fluidly connected to the four mold cavities 708(1) to 708(4) via a conduit system 720 (FIG. 7C) located with the reservoir. In this example, the mold portion 708 includes a lower part 708A that is hingedly attached to an upper part 708B so that the mold cavities 708(1) to 708(4) are split at their equators for removing the fully frozen ice spheres (not shown). During use, when the mold cavities 708(1) to 708(4) are filled with freezable liquid, the reservoir 712 also contains freezable liquid that replenishes the freezable liquid that the suction pump 716 draws from the mold cavities as the freezable liquid progressively freezes within the mold cavities in the active-core manner described above. Each of the mold cavities 708(1) to 708(4) has an associated outlet-inlet structure 724(1) to 724(4) that may be identical to the outlet-inlet structure 312 of FIGS. 3A to 3C, with the center passageways (not labeled, but each like passageway 316 of FIGS. 3A to 3C) being part of the conduit system 720 fluidly coupled to the suction pump 716 (FIGS. 7A and 7B) and the annular outer passageways (not labeled, but each like passageway 320 of FIGS. 3A to 3C) directly fluidly connecting the corresponding respective ones of the mold cavities 708(1) to 708(4) to the reservoir 712 so that the flow of replenishing freezable liquid from the reservoir to the mold cavities is by gravity. The outlet 716A (FIGS. 7A and 7B) of the suction pump 716 returns the portions of the freezable liquid drawn from the mold cavities 708(1) to 708(4) to the reservoir 712. Those skilled in the art will readily appreciate that the components and features of the icemaker 700 of FIGS. 7A to 7C that have similar names as the components and features of the icemaker 100 of FIG. 1 have the same or similar function as those components and features of the icemaker of FIG. 1.

FIG. 8A to 8M illustrate another embodiment 800 of the icemaker 100 of FIG. 1. Components and features of icemaker 800 include:

804: Head Unit
804A: Lid
804B: Base
808: Mold Unit

808A: Upper Component of Mold Unit 808
808A(1): Upper Semispherical Mold Half
808B: Lower Component of Mold Unit 808
808B(1): Lower Semispherical Mold Half
812: On/Off Button Switch
816: Reservoir
820: Pump Compartment
824A: Fill Hole
824B: Fill Hole Closure
828: Battery Compartment
828A: Battery Compartment Opening
828B: Battery Compartment Closure
832A: Outlet-Inlet Structure Opening
836A: Head Unit/Mold Unit Mechanical-Interlock Receivers
836B: Head Unit/Mold Unit Mechanical-Interlock Catches Although not illustrated, in one functioning embodiment, the pump compartment 820 holds a small 6V water pump that is wired to the illuminated on/off button switch 812 and a rechargeable 18650 3.7V lithium ion battery residing in the battery compartment 828. In an example instantiation, the pump used is model ZL25-02 made by Dongguan Zhonglong Pump Technology Co. Ltd., Dongguan City, Guangdong Province, China. The head unit 804 is closed/assembled by affixing the lid 804A and securing the closures 828B and 824B, respectively, to the side battery compartment 828 and the fill hole 824. The head unit 804 is then attached to the 2-piece mold unit 808. In this embodiment, when the pump is installed, a pump inlet (not shown) of the pump, in conjunction with the outlet-inlet structure opening 832A, form the outlet-inlet structure (not shown) in a manner similar to outlet-inlet structure 312 of FIG. 3C, with the pump suction inlet being centrally located relative to the outlet-inlet structure opening so as to define a central outlet flow passageway, an annular inlet flow passageway, and a gap similar to, respectively, the central outlet flow passageway 316, the annular inlet flow passageway 320, and the gap G of FIG. 3C. In the example instantiation, the diameter of the outlet-inlet structure opening 832A is 14 mm, and the pump suction inlet has a 9.9 mm outer diameter and a 6.3 mm inner diameter, with the 6.3 mm inner diameter defining the outlet flow passageway from the mold cavity. With the 14 mm diameter outlet-inlet structure opening 832A and the 9.9 mm outer diameter of the pump suction inlet, the width of the annular inlet flow passageway, which is in fluid communication with the reservoir 816, is 14 mm-9.9 mm=4.1 mm.

To use the icemaker 800, a user opens the fill hole closure 824A and fills the spherical mold (2.5 inches in diameter in the example instantiation) of the mold unit 808 and the reservoir 816 in the head unit 804 with freezable liquid (e.g., water) (not shown). Then, the user presses the on/off button switch 812 to turn on the pump (not shown), which, in this example, operates at approximately 0.8-1.0 liters per minute (L/M) at 3.7V/1.6 A using the pump noted above. The pump continuously pumps the freezable liquid out of the spherical mold via the central freezable-liquid outlet 832A and into the reservoir 816, and then the water naturally flows back into the spherical mold from the reservoir via the annular freezable-liquid inlet. Once full of water and turned on, the entire icemaker 800 is placed into a freezer or any environment (not shown) at a suitable temperature, such as a temperature at or below +10 degrees Fahrenheit. After the freezable liquid in the sphere mold has frozen solid (e.g., 5-12 hours depending on freezing conditions/temperature), the 2-piece mold unit 808 can be twisted off of the head unit 804 and the upper and lower components 808A and 808B of the mold unit 808 can be separated to reveal a substantially clear ice sphere.

Experimentally, the above pump has been tested in the icemaker 800 at a voltage from 2V to 6V and flow rates from 0.7 L/M-1.6 L/M with successful results. The specific power input and flow rate can be adjusted to achieve specific ice sizes/shapes and freeze duration and could be outside of these ranges for larger ice shapes or a higher quantity of ice. Other pumps with higher voltage and/or flow rates can also be substituted but the layout/design would need to be adjusted accordingly to ensure the consistent freezing of substantially clear ice shapes in the least amount of time.

The foregoing has been a detailed description of illustrative embodiments of the disclosure. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this disclosure. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present disclosure.

What is claimed is:

1. An icemaker for making at least one body of ice from a freezable liquid having one or more impurities, wherein the at least one body of ice has a shape and a size, the icemaker comprising:

at least one mold having a closed mold cavity designed and configured to provide the shape and size of the at least one body of ice when the at least one mold is filled with the freezable liquid and the freezable liquid is frozen to form the at least one body of ice, wherein the at least one mold has a suction outlet and a replenishment inlet each in fluid communication with the mold cavity;

a reservoir that contains some of the freezable liquid during freezing of the freezable liquid within the closed mold cavity;

a suction device; and a recirculation loop that recirculates unfrozen portions of the freezable liquid through the mold cavity during the freezing of the freezable liquid within the closed mold cavity, the recirculation loop consisting of:

the mold cavity;

the suction device in fluid communication with the mold cavity via the suction outlet and with the reservoir; and the reservoir open to the mold cavity via the replenishment inlet during the freezing of the freezable liquid within the closed mold cavity;

wherein, during the freezing of the freezable liquid:

the suction device draws unfrozen freezable liquid from the closed mold cavity and delivers the unfrozen freezable liquid, so drawn, to the reservoir; and the reservoir replenishes the unfrozen freezable liquid drawn from the closed mold cavity by gravity feed of unfrozen freezable liquid in the reservoir;

wherein the icemaker is configured so that, during operation of the icemaker, directionality of the freezing of the freezable liquid within the closed mold cavity is controlled so that the ice advancingly pushes the one or more impurities in the unfrozen freezable liquid within the closed mold cavity toward the suction outlet for removal by the suction device.

2. The icemaker of claim 1, wherein the mold has:

an inlet flow passageway fluidly connecting the reservoir and the replenishment inlet; and an outlet flow passageway fluidly connecting the suction outlet and the suction device.

3. The icemaker of claim 2, wherein the inlet flow passageway and the outlet flow passageway are arranged concentrically with one another.

4. The icemaker of claim 3, wherein the outlet flow passageway is defined by an inner conduit and the inlet flow passageway is defined by the inner conduit and an outer conduit.

5. The icemaker of claim 4, wherein the inlet flow passageway has an end offset from an end of the outlet flow passageway so as to define a bypass that allows the freezable liquid to flow from the inlet flow passageway to the outlet flow passageway without entering the closed mold cavity.

6. The icemaker of claim 2, wherein the inlet flow passageway and the outlet flow passageway have corresponding respective central flow axes that are parallel to one another at the mold.

7. The icemaker of claim 6, wherein the central flow axes are spaced from one another.

8. The icemaker of claim 6, wherein the central flow axes are coincident with one another.

9. The icemaker of claim 6, further including a bypass located immediately adjacent to the closed mold cavity and designed and configured to allow freezable liquid to flow from the inlet flow passageway to the outlet flow passageway without entering the closed mold cavity.

10. The icemaker of claim 2, further including a bypass located immediately adjacent to the closed mold cavity and designed and configured to allow freezable liquid to flow from the inlet flow passageway to the outlet flow passageway without entering the closed mold cavity.

11. The icemaker of claim 1, wherein the suction device comprises a recirculation pump operatively configured to return the unfrozen freezable liquid to the reservoir.

12. The icemaker of claim 1, comprising a plurality of molds each having a closed mold cavity, wherein the reservoir is open to each closed mold cavity.

13. The icemaker of claim 1, wherein the inlet flow passageway and the outlet flow passageway are configured and oriented so that, during use of the icemaker, the icemaker maintains an active core within the closed mold cavity as the body of ice forms.

14. The icemaker of claim 13, wherein the icemaker is configured to be placed within a freezer compartment of a domestic or commercial freezer.

15. The icemaker of claim 13, wherein the icemaker does not include any thermal insulation surrounding the mold so that the ice body grows inwardly toward the active core.

16. The icemaker of claim 13, wherein the mold includes a wall defining the closed mold cavity, and the wall includes internal cooling passageways for carrying a cooling fluid that causes the freezable liquid in the closed mold cavity to freeze in a direction from the wall to the active core.

17. A method of making a body of ice from a freezable liquid having one or more impurities, the body of having a size and a shape, the method comprising:

filling a closed mold cavity with a freezable liquid, wherein the closed mold cavity has the size and shape of the body of ice;

causing the freezable liquid in the closed mold cavity to freeze within the closed mold cavity in a direction so that the ice advancingly pushes the one or more impurities in the unfrozen freezable liquid within the closed cavity mold toward a suction outlet of the closed mold cavity;

while causing the freezable liquid to freeze within the closed mold cavity, simultaneously recirculating unfrozen freezable liquid, wherein the recirculating consist of:

drawing unfrozen freezable liquid out of the closed mold cavity via the suction outlet so as to remove any of the one or more impurities present in the unfrozen freezable liquid;

delivering the unfrozen freezable liquid, so drawn, to a reservoir; and allowing unfrozen freezable liquid delivered to the reservoir to flow by gravity back into the closed mold cavity.

18. The method of claim 17, wherein causing the freezable liquid in the closed mold cavity to freeze includes locating the closed mold cavity and the freezable liquid therein in a freezer compartment of a freezer.

19. The method of claim 18, wherein the closed mold cavity is formed in a mold, the method further comprising filling the closed mold cavity with the freezable liquid outside of the freezer compartment and then placing the mold into the freezer compartment so as to cause the freezable liquid in the closed mold cavity to freeze.

20. The method of claim 19, wherein drawing unfrozen freezable liquid out of the closed mold cavity includes suction-pumping the unfrozen freezable liquid out of the closed mold cavity using a battery-powered suction pump.

* * * * *